US010842211B2

(12) United States Patent
Inoue et al.

(10) Patent No.: US 10,842,211 B2
(45) Date of Patent: Nov. 24, 2020

(54) HEAT-RETAINING ARTICLE

(71) Applicant: GOLDWIN INC., Toyama (JP)

(72) Inventors: Kazuhiro Inoue, Toyama (JP); Hirotatsu Shibata, Tokyo (JP)

(73) Assignee: GOLDWIN INC., Toyama (JP)

( * ) Notice: Subject to any disclaimer, the term of this patent is extended or adjusted under 35 U.S.C. 154(b) by 327 days.

(21) Appl. No.: 15/546,145

(22) PCT Filed: Jan. 12, 2016

(86) PCT No.: PCT/JP2016/050722
§ 371 (c)(1),
(2) Date: Jul. 25, 2017

(87) PCT Pub. No.: WO2016/121492
PCT Pub. Date: Aug. 4, 2016

(65) Prior Publication Data

US 2018/0116317 A1 May 3, 2018

(30) Foreign Application Priority Data

Jan. 26, 2015 (JP) ..... 2015-012820
Jul. 22, 2015 (JP) ..... 2015-144851

(51) Int. Cl.
*B32B 7/08* (2019.01)
*A41D 31/06* (2019.01)
(Continued)

(52) U.S. Cl.
CPC ..... *A41D 31/065* (2019.02); *A41D 1/02* (2013.01); *A41D 3/00* (2013.01); *A41D 27/00* (2013.01);
(Continued)

(58) Field of Classification Search
CPC . A41D 1/02; A41D 3/00; A41D 27/00; A41D 31/00; A41D 31/0005; A41D 31/02;
(Continued)

(56) References Cited

U.S. PATENT DOCUMENTS 4,563,785 A * 1/1986 Samelson ..... A47G 9/10 112/475.08
5,408,700 A * 4/1995 Reuben ..... A41D 27/02 112/402
(Continued)

FOREIGN PATENT DOCUMENTS

CN 2867920 Y 2/2007
EP 0659372 A2 6/1995
(Continued)

OTHER PUBLICATIONS

Machine Translation of JP 2005-194649 (Year: 2005).*
(Continued)

*Primary Examiner* — Prashant J Khatri
*Assistant Examiner* — Zachary M Davis
(74) *Attorney, Agent, or Firm* — Osha Berman Watanabe & Burton LLP

(57) ABSTRACT

The purpose of the present invention is to provide a heat-retaining article exhibiting excellent heat retention. This heat-retaining article (1) is configured so as to be provided with a first sheet (12), a second sheet (13), and a filler material (15) positioned between the first sheet (12) and the second sheet (13), and is characterized by being equipped with a plurality of joining sections (11) for joining the first sheet (12) and the second sheet (13) to one another, and in that the plurality of joining sections (11) are separated from one another and form a dot pattern.

12 Claims, 8 Drawing Sheets

(51) Int. Cl.

| | |
|---|---|
| ***A41D 27/00*** | (2006.01) |
| ***A47G 9/02*** | (2006.01) |
| ***A41D 31/00*** | (2019.01) |
| ***A41D 31/02*** | (2019.01) |
| ***A41D 1/02*** | (2006.01) |
| ***A41D 3/00*** | (2006.01) |

(52) U.S. Cl.
CPC ..... *A41D 31/00* (2013.01); *A41D 31/02* (2013.01); *A47G 9/02* (2013.01); *A41D 2400/10* (2013.01); *A47G 9/0223* (2013.01)

(58) Field of Classification Search
CPC .. A41D 31/06; A41D 31/065; A41D 2400/10; A47G 9/02; A47G 9/08; A47G 9/0223; B32B 3/06; B32B 3/08; B32B 3/20; B32B 7/05; B32B 2307/304; B32B 2437/00
USPC ..... 112/2.2, 420, 439
See application file for complete search history.

(56) References Cited

U.S. PATENT DOCUMENTS

| | | | | |
|---|---|---|---|---|
| 5,799,600 | A | 9/1998 | Reuben | |
| 2002/0137412 | A1 | 9/2002 | Grilliot et al. | |
| 2008/0307566 | A1 | 12/2008 | Yeh | |
| 2013/0177731 | A1* | 7/2013 | Moriarty ..... | B32B 27/12 428/74 |
| 2016/0122912 | A1 | 5/2016 | Takayanagi et al. | |

FOREIGN PATENT DOCUMENTS

| | | | | |
|---|---|---|---|---|
| JP | S56-27069 | U | | 3/1981 |
| JP | 56-48508 | | | 4/1981 |
| JP | S56-34487 | U | | 4/1981 |
| JP | S5634487 | U | * | 4/1981 |
| JP | 180218 | U | | 12/1983 |
| JP | S62-136513 | U | | 8/1987 |
| JP | 07-009160 | U | | 2/1995 |
| JP | 2003-144284 | A | | 5/2003 |
| JP | 2005-194649 | A | | 7/2005 |
| JP | 2005194649 | A | * | 7/2005 |
| JP | 3155367 | U | | 11/2009 |
| JP | 2010-18941 | A | | 1/2010 |
| JP | 2010-275651 | A | | 12/2010 |
| KR | 101053255 | B1 | | 8/2011 |
| WO | 2014087161 | A1 | | 6/2014 |
| WO | 2014/196566 | A1 | | 12/2014 |

OTHER PUBLICATIONS

Machine Translation of JP 556-34487U (Year: 1981).*
Extended European Search Report issued in European Application No. 16743096.6; dated Nov. 29, 2018 (7 pages).
Office Action issued in Korean Application No. 10-2017-7019681, dated Apr. 17, 2018 (11 pages).
International Search Report and Written Opinion dated Apr. 19, 2016, by the Japan Patent Office in corresponding International Application No. PCT/JP2016/050722, with English translation (15 pages).
International Preliminary Report on Patentability with Written Opinion dated Aug. 1, 2017, by The International Bureau of WIPO in corresponding International Application No. PCT/JP2016/050722, with English translation (12 pages).
Office Action issued in corresponding Japanese Application No. 2016-502554, dated May 12, 2020 (6 pages).

* cited by examiner

HEAT-RETAINING ARTICLE

TECHNICAL FIELD

The present invention relates to a heat retaining article.

BACKGROUND ART

In heat retaining articles that include filler materials such as down feathers, feathers and batting between front fabrics and back fabrics, in order to keep the filler from accumulating at one end, often the front fabric and the back fabric are sewn together in lines so as to form several compartments, and the filler is accommodated within the compartments.

In PTL 1, for example, there is described an article of clothing wherein a stretchable thread having the ability to stretch is used for either or both a front thread and an intertwining looper thread for stitching of several cloths that are overlaid in the thickness direction in the state of being laid, to form a stretchable cloth with the ability to stretch, and at least a portion of the article of clothing is formed by the stretchable cloth.

In PTL 2 there is described a quilt with partitioning walls provided in compartments accommodating a filler, for an increased heat retaining property.

A similar seat cushion is described in PTL 3.

CITATION LIST

Patent Literature

PTL 1 Japanese Unexamined Patent Publication No. 2010-275651

PTL 2 Japanese Unexamined Patent Publication No. 2003-144284

PTL 3 Japanese Unexamined Utility Model Publication HEI No. 7-9160

SUMMARY OF INVENTION

Technical Problem

With the clothing article described in PTL 1, since the filler is not present at the seams that are the borders of the compartments, while the amount of filler is reduced and the thicknesses of the seam sections are also thin, a problem that has been encountered is that "cold spots" tend to form where heat escapes from the seams and the heat retaining property of the heat retaining article is impaired.

Moreover, the quilt and seat cushion described in PTLs 2 and 3, while exhibiting excellent heat retaining properties, tend to have complex structures.

Solution to Problem

The present inventors have found a heat retaining article comprising a first sheet, a second sheet and a filler situated between the first sheet and the second sheet, wherein the heat retaining article comprises a plurality of joining sections that join the first sheet and the second sheet, the plurality of joining sections being interspersed with mutual spacings therebetween.

Advantageous Effects of Invention

The heat retaining article of the invention has excellent heat retaining properties.

DESCRIPTION OF EMBODIMENTS

An embodiment of the heat retaining article of the invention will now be described with reference to the accompanying drawings.

FIG. 1 to FIG. 4 are diagrams for illustration of a heat retaining article 1, and specifically a down jacket, according to one embodiment (first embodiment) of the invention.

Figure 1:
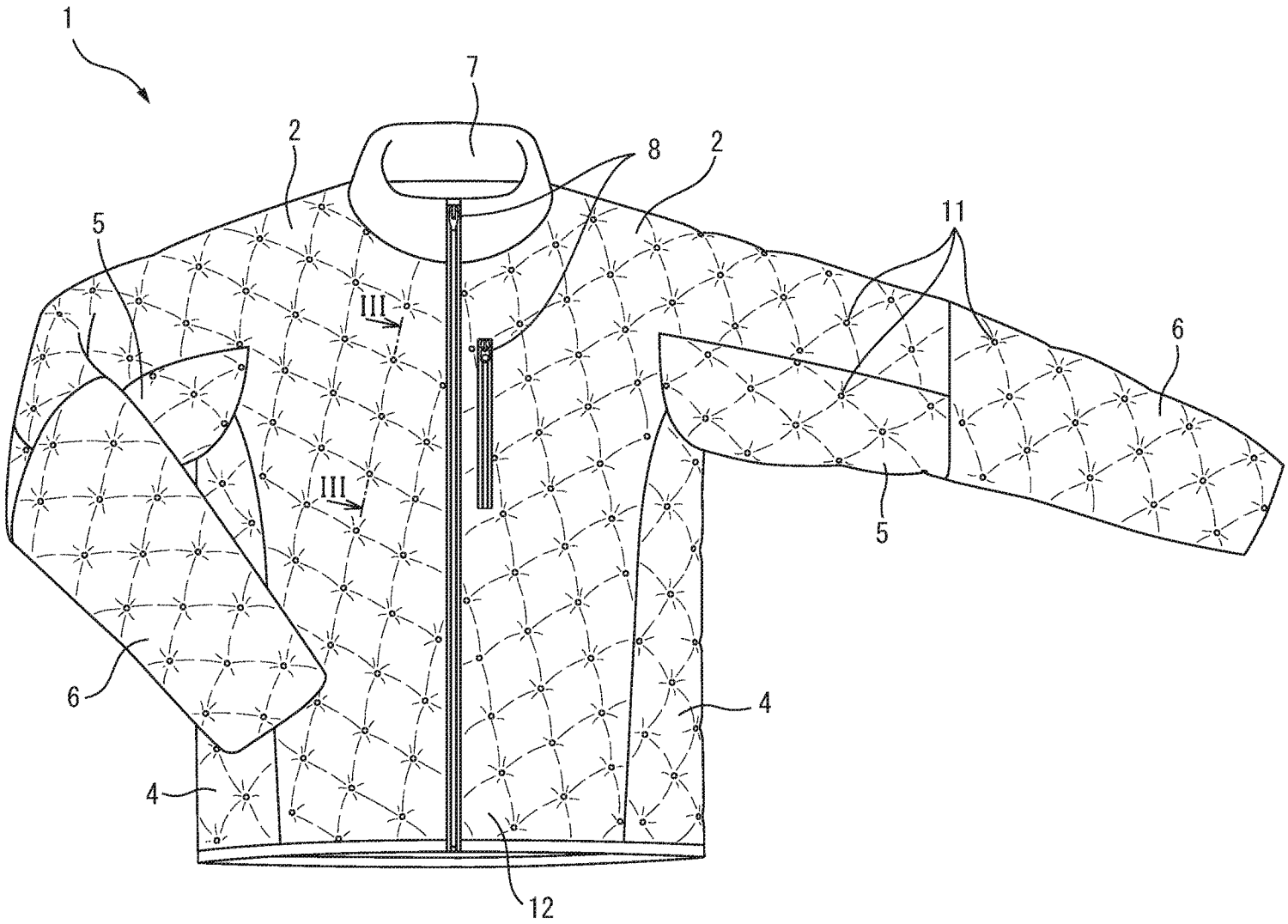
FIG. 1 is a front view of a heat retaining article 1 according to a first embodiment of the invention.
Figure 2:
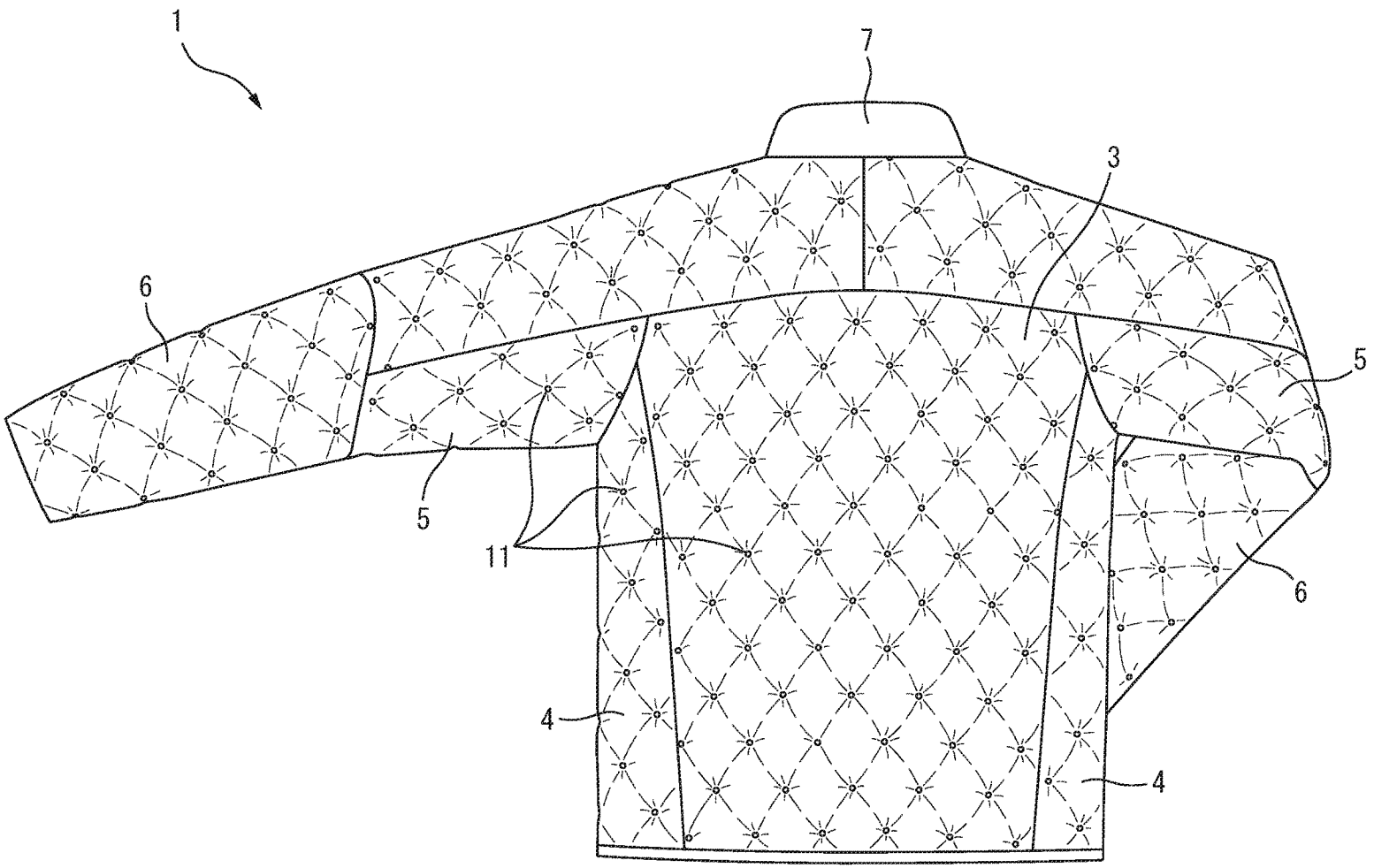
FIG. 2 is a rear view of a heat retaining article 1 according to a first embodiment of the invention.
Figure 3:
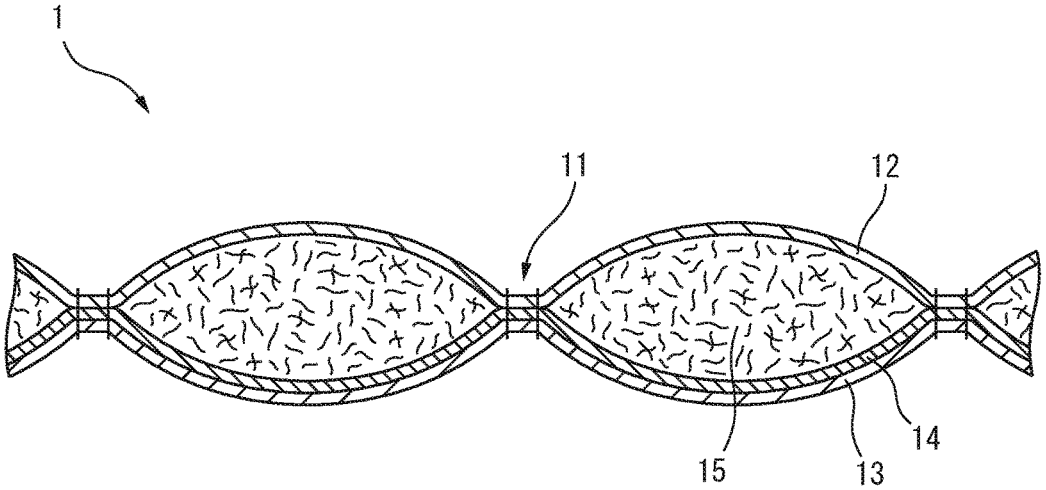
FIG. 3 is an end view along edge III-III of FIG. 1.
Figure 4:
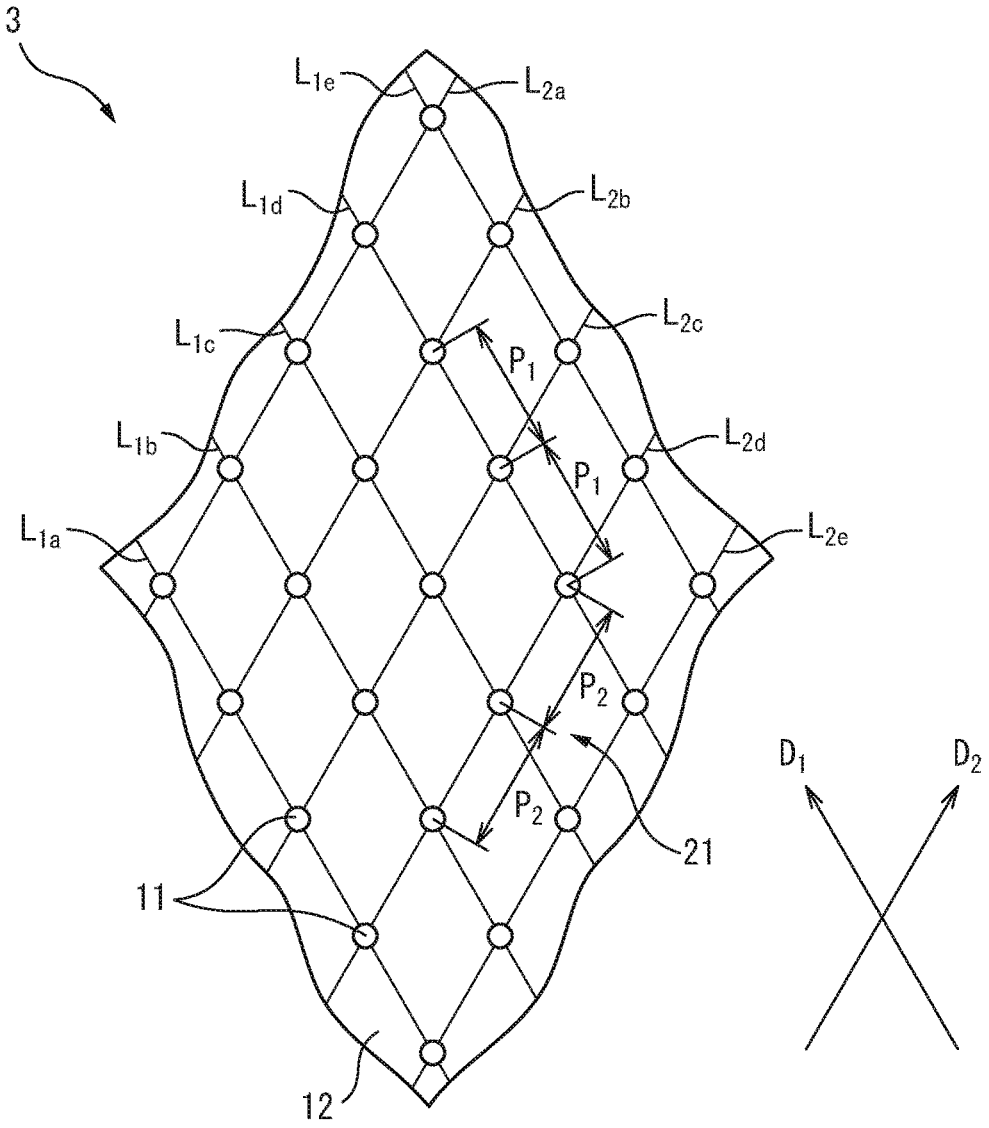
FIG. 4 is a partial magnified view of the rear body region of a heat retaining article 1 according to a first embodiment of the invention.
Figure 5A:
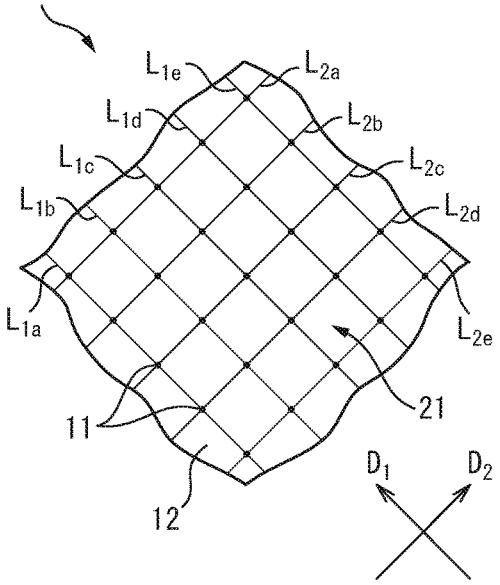
FIGS. 5(*a*)-5(*d*) are diagrams showing an example of variation of the arrangement of joining sections.
Figure 5B:
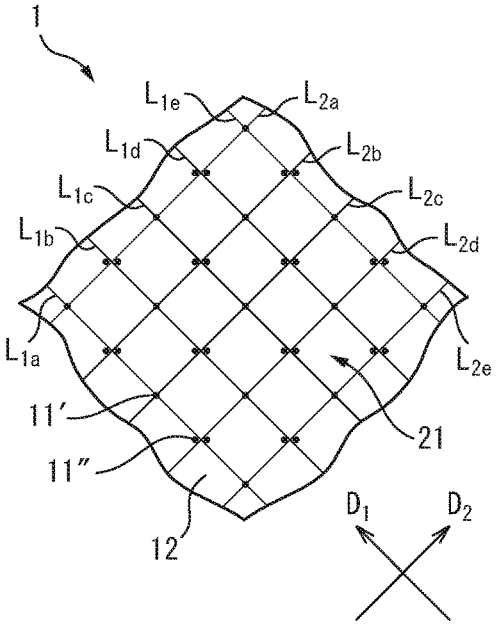
Figure 5C:
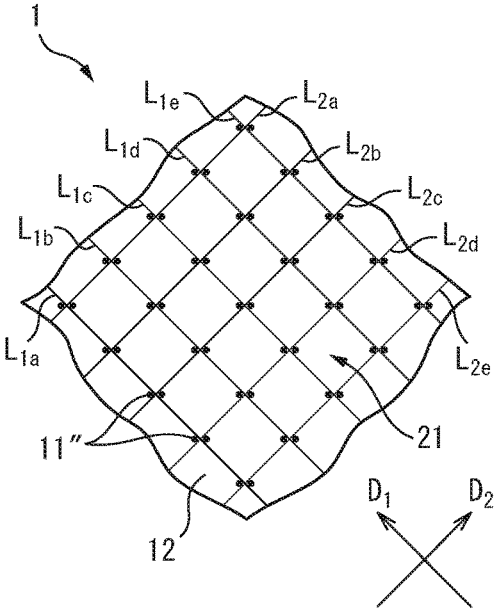
Figure 5D:
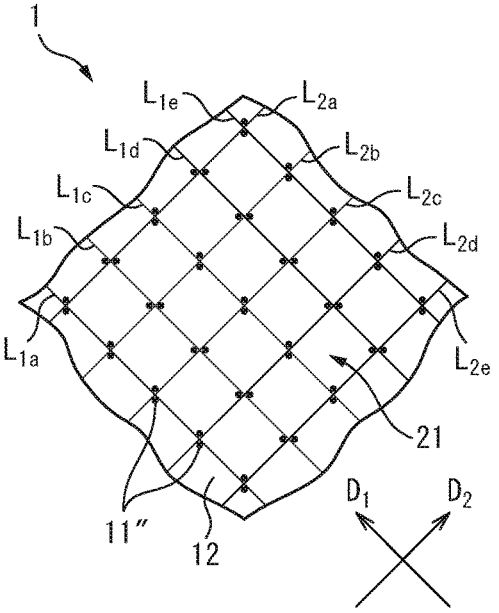

FIG. 1 is a front view of the heat retaining article 1, FIG. 2 is a rear view of the heat retaining article 1, FIG. 3 is an end view along edge III-III in FIG. 1, and FIG. 4 is a magnified view of the back side of the heat retaining article 1.

As shown in FIG. 1 and FIG. 2, the heat retaining article 1 of the first embodiment is partitioned into a pair of front body regions 2, a rear body region 3, a pair of left and right flank abdominal regions 4, a pair of left and right sleeve lower sections 5, a pair of left and right sleeve sections 6 and a collar section 7, and it also comprises a fastener section 8. Also, as shown in FIG. 1 and FIG. 2, the heat retaining article 1 of the first embodiment comprises a plurality of joining sections 11 arranged in the pair of front body regions 2, the rear body region 3, the pair of left and right flank abdominal regions 4, the pair of left and right sleeve lower sections 5 and the pair of left and right sleeve sections 6. The plurality of joining sections 11 are interspersed with mutual spacings therebetween.

As shown in FIG. 3, the heat retaining article 1 of the first embodiment comprises a first sheet 12, a second sheet 13, a third sheet 14 and a filler 15. The heat retaining article 1 of the first embodiment comprises joining sections 11 that join the first sheet 12, the second sheet 13 and the third sheet 14. According to the first embodiment, the joining sections 11 do not join the filler 15.

FIG. 4 is a partial magnified view of the rear body region 3 of a heat retaining article 1 according to a first embodiment of the invention. For the first embodiment, as shown in FIG. 4, the joining sections 11 are stitched sections formed by embroidering, and the joining sections 11 that are the stitched sections have circular shapes on the outer side 21 of the first sheet 12, which is the side opposite the filler 15 side.

As shown in FIG. 4, the plurality of joining sections 11 are arranged on a group of first imaginary lines $L_{1a}$-$L_{1e}$ that are mutually parallel and extending in a first direction $D_1$, in the planar direction of the heat retaining article 1. The plurality of joining sections 11 are also arranged on a group of second imaginary lines $L_{2a}$-$L_{2e}$ that are mutually parallel and extending in a second direction $D_2$, crossing with the first direction $D_1$, in the planar direction of the heat retaining article 1.

The plurality of joining sections 11 are arranged on the intersections between the group of first imaginary lines $L_{1a}$-$L_{1e}$ and the group of second imaginary lines $L_{2a}$-$L_{2e}$.

The plurality of joining sections 11 are arranged at a fixed pitch $P_1$ on each of the group of first imaginary lines $L_{1a}$-$L_{1e}$. The plurality of joining sections 11 are also arranged at a fixed pitch $P_2$ on each of the group of second imaginary lines $L_{2a}$-$L_{2e}$.

The heat retaining article of the invention includes a plurality of joining sections interspersed with mutual spacings therebetween, as illustrated by the first embodiment. Having the cold spot-forming joining sections interspersed allows the heat retaining article of the invention to have excellent heat retaining properties. Moreover, due to the small sizes of the cold spots that are formed, the user is less likely to feel a cold sensation.

For the first embodiment, the plurality of joining sections 11 are arranged on the intersections between the group of first imaginary lines $L_{1a}$-$L_{1e}$ extending in the first direction $D_1$ and the group of second imaginary lines $L_{2a}$-$L_{2e}$ extending in the second direction $D_2$, but the plurality of joining sections in the heat retaining article of the invention do not need to be arranged along any particular direction.

While the arrangement does not need to be along any particular direction in the heat retaining article of the invention, the number density of the joining sections is preferably 50 to 700 ($m^{-2}$), more preferably 100 to 650 ($m^{-2}$) and even more preferably 200 to 600 ($m^{-2}$), in the planar direction.

The number density is the number of joining sections per unit area (1 $m^2$) in the planar direction of the heat retaining article.

In the heat retaining article of the invention, the filler has a basis weight of preferably 40 to 250 g/$m^2$, more preferably 50 to 250 g/$m^2$, even more preferably 55 to 220 g/$m^2$ and yet more preferably 60 to 180 g/$m^2$. This is from the viewpoint of the heat retaining properties and appearance quality.

In the heat retaining article of the invention, the value X, obtained by the following formula (1):

$$X = A \times \sqrt{n} \qquad \text{formula (1)}$$

wherein A is the basis weight of the filler (g/$m^2$), and n is the number density of the joining sections ($m^{-2}$), is in the range of preferably 1,400 to 1,800, more preferably 1,430 to 1,770 and even more preferably 1,450 to 1,750.

If the value X is within this range, then the density of the filler will be in the prescribed range, the heat retaining properties of the heat retaining article will be excellent, and the filler will be less likely to become maldistributed.

The density of the filler is calculated by dividing the basis weight of the filler in the heat retaining article by the thickness of the filler, but the thickness of the filler tends to be proportional to the distance between the nearest joining sections. Since the distance also tends to be inversely proportional to the square root of the number density of the joining sections, the basis weight of the filler can be multiplied by the square root of the number density of the joining sections to obtain the value X which is proportional to the density of the filler.

If the heat retaining article of the invention has a number density of joining sections in the range specified above, then the thickness of the heat retaining article will be maintained in the prescribed range, it will be easier for the filler to be kept in the prescribed density range, and the filler will be less likely to be maldistributed. Since the joining sections also have a function of inhibiting maldistribution of the filler, the filler is less likely to be maldistributed from this viewpoint as well.

In the heat retaining article of the invention, as illustrated by the first embodiment, the plurality of joining sections are preferably arranged on a plurality of first imaginary lines that are mutually parallel and extending in the first direction. This will help the plurality of joining sections to be uniformly arranged in the planar direction of the heat retaining article, tending to result in excellent heat retaining properties for the heat retaining article.

When the plurality of joining sections are arranged on the first imaginary line, the plurality of joining sections are preferably arranged at a prescribed pitch on the first imaginary line, being arranged at a pitch of preferably 20 to 150 mm, more preferably 25 to 120 mm and even more preferably 30 to 90 mm.

If the plurality of joining sections are arranged at such a pitch on the first imaginary line, the thickness of the heat retaining article of the invention will be more likely to be constant, thermal insulation irregularities will be less likely to be produced, and the filler will be less likely to be maldistributed.

In the heat retaining article of the invention, as illustrated by the first embodiment, the plurality of joining sections are preferably arranged on a plurality of second imaginary lines that are mutually parallel and extending in the second direction that is crossing with the first direction. This will help the plurality of joining sections to be uniformly arranged in the planar direction of the heat retaining article, tending to result in excellent heat retaining properties for the heat retaining article.

When the plurality of joining sections are arranged on the second imaginary line, the plurality of joining sections are preferably arranged at a prescribed pitch on the second imaginary line, being arranged at a pitch of preferably 20 to 150 mm, more preferably 25 to 120 mm and even more preferably 30 to 90 mm.

If the plurality of joining sections are arranged at such a pitch on the second imaginary line, the thickness of the heat retaining article of the invention will be more likely to be constant, thermal insulation irregularities will be less likely to be produced, and the filler will be less likely to be maldistributed.

The joining sections are preferably arranged on the intersections between the first imaginary lines and the second imaginary lines.

In the heat retaining article of the invention, the plurality of joining sections may also be arranged in another direction crossing with the first direction and the second direction, such as on third imaginary lines extending in a third direction. This thickness of the heat retaining article of the invention will thereby be more likely to be constant, thermal insulation irregularities will be less likely to be produced, and the filler will be less likely to be maldistributed.

According to the first embodiment, the joining sections 11 are stitched sections formed by embroidering, but the joining sections in the heat retaining article of the invention are not limited to being stitched sections. Each of the plurality of joining sections in the heat retaining article of the invention may instead be bonded sections, fused sections, or caulked sections, for example.

Examples of the bonded sections include sections bonded with an adhesive. Examples of the fused sections include fused sections of thermoplastic resin fibers, wherein, for example, at least one of the first sheet, second sheet or optional third sheet includes thermoplastic resin fibers and the fused sections are formed of the thermoplastic resin fibers. The caulked sections may be caulked sections formed by caulking of a first member (for example, a male member) and a second member (for example, a female member).

The joining sections in the heat retaining article of the invention are preferably stitched sections. This is to provide the joining sections with an excellent feel on the skin and excellent strength. It is also to allow the joining sections to be easily given specific shapes as stitched sections.

In addition, the cross-sectional shapes of the stitched sections in the planar direction of the heat retaining article (the "cross-sectional shapes in the planar direction of the heat retaining article" will hereunder also be referred to simply as "cross-sectional shapes") may be specific shapes, such as geometrical shapes (for example, circular, elliptical or polygonal shapes), or the shapes of arrows, numerals, letters or characters, or any desired combinations thereof. The cross-sections of the stitched sections are preferably circular or elliptical shapes. This will increase the strength of the joining sections, while also making the first sheet and second sheet less likely to tear. The specific shapes may also be on the side of the first sheet opposite the filler.

FIG. 5 is a diagram showing examples of variations of arrangement of the joining sections in the heat retaining article of the invention, as plan views corresponding to FIG. 4. FIG. 5(*a*) is identical to FIG. 4 except for a different angle of crossing between the first direction $D_1$ and the second direction $D_2$. In FIG. 5(*a*), the plurality of joining sections 11 are arranged in a 90° zigzag pattern.

FIG. 5(*b*) to FIG. 5(*d*) are examples where the cross-sectional shapes of the joining sections 11 (stitched sections) include combinations of multiple shapes, and specifically combinations of two circular shapes.

FIG. 5(*b*) is an example in which, on the group of first imaginary lines $L_{1a}$-$L_{1e}$ and the group of second imaginary lines $L_{2a}$-$L_{2e}$, joining sections 11' (stitched sections) with single circular cross-sectional shapes and joining sections 11" (stitched sections) with double circular cross-sectional shapes are arranged in an alternating manner.

FIG. 5(*c*) is an example in which, on the group of first imaginary lines $L_{1a}$-$L_{1e}$ and the group of second imaginary lines $L_{2a}$-$L_{2e}$, only joining sections 11" (stitched sections) with double circular cross-sectional shapes are arranged.

FIG. 5(*d*) is an example in which joining sections 11" (stitched sections) with double circular cross-sectional shapes and joining sections 11" (stitched sections) with double circular cross-sectional shapes are arranged in an alternating manner. The joining sections 11" (stitched sections) and joining sections 11" (stitched sections) differ in the direction in which the two circular shapes are arranged.

The first embodiment includes a third sheet 14 between the filler 15 and the second sheet 13, but the heat retaining article of the invention does not need to include a third sheet. If a third sheet is not included, the structure of the heat retaining article of the invention will be simplified, which is advantageous from a cost standpoint.

In an embodiment in which the heat retaining article of the invention includes a third sheet, the third sheet is preferably present as a fabric. This will make the filler less likely to be maldistributed. The construction of the third sheet is as follows.

Figure 6:
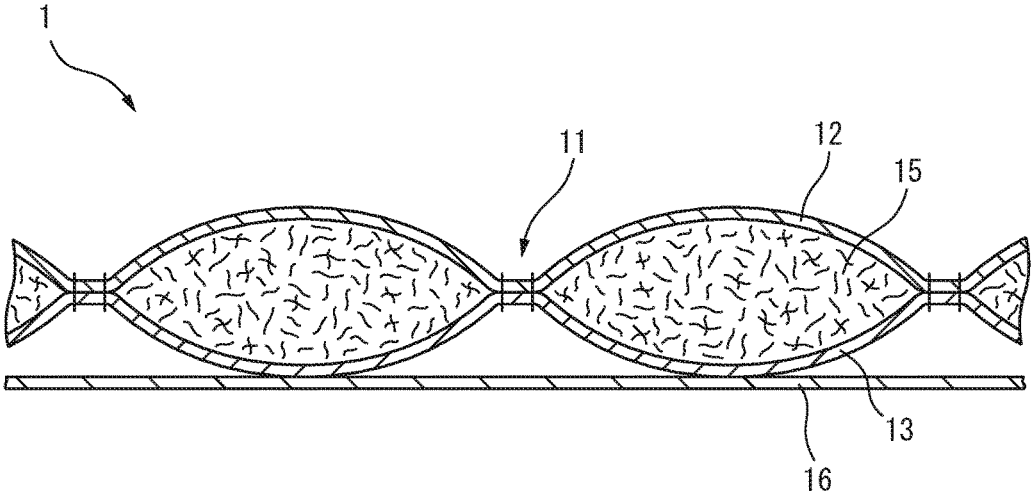
FIG. 6 is an end view for illustration of a heat retaining article 1 according to another embodiment of the invention.

FIG. 6 is a diagram for illustration of a heat retaining article 1 according to another embodiment (second embodiment) of the invention, corresponding to an end view along edge III-III of FIG. 1. The heat retaining article 1 shown in FIG. 6 comprises a first sheet 12, a second sheet 13 and a filler 15 disposed between the first sheet 12 and the second sheet 13, and it further comprises a plurality of joining sections 11 that join the first sheet 12 and the second sheet 13.

The heat retaining article 1 shown in FIG. 6 also comprises, on the outer side of the second sheet 13, a cover sheet 16 that is not joined by the plurality of joining sections 11 and covers the second sheet.

The heat retaining article 1 of the second embodiment has excellent heat retaining properties because it further comprises the cover sheet 16. Moreover, in the second embodiment, when the plurality of joining sections are stitched sections formed by embroidering, one side of the stitched sections may be concealed.

In the heat retaining article of the invention, the first sheet, the second sheet and the optional third sheet may be fabrics, such as woven fabrics, knitted fabrics or nonwoven fabrics, including relatively light synthetic fibers with high tensile strength and high frictional strength, for example, thermoplastic resin fibers. Examples of such synthetic fibers include nylon and polyester.

The filler used in the heat retaining article of the invention may be any one used as a filler in the technical field, without any particular restrictions, and it preferably includes at least one from among down feathers, feathers and batting, and more preferably it includes down feathers and feathers.

As the filler, the heat retaining article includes down feathers in a proportion of at preferably 50 to 90 mass %, more preferably 65 to 95 mass % and even more preferably 70 to 93 mass %, of the total mass of down feathers and feathers. If the proportion of down feathers is within this range, the heat retaining article will be able to exhibit both lightweight and heat retaining properties.

As the filler, the heat retaining article includes feathers at preferably 10 to 50 mass %, more preferably 5 to 35 mass % and even more preferably 7 to 30 mass %, of the total mass of down feathers and feathers. If the proportion of feathers is within this range, the filler will be less likely to collapse, and the heat retaining article will have excellent heat retaining properties even when a given pressure has been applied to the heat retaining article.

As used herein, "down feathers" and "feathers" are used as different concepts. The term "down feathers" means growths having barbs extending in an approximately radial manner from the shaft. Such down feathers are also referred to as "down", and include the extremely soft growths that have grown on the chests of waterfowl, such as domesticated ducks, wild ducks or geese. Because down feathers include numerous air layers (air pockets), they have excellent heat retaining properties.

The bulk of down feathers is referred to as filling power (FP), and down which has a higher FP value is more lightweight and exhibits more excellent heat retaining properties. The FP value of down feathers to be used in the heat retaining article of the invention is preferably 500 to 1000, more preferably 550 to 900 and even more preferably 600 to 750, based on the IDFB method.

The term "feathers" means growths having barbs extending from the shaft, in the same manner as tree leaves.

Feathers are also referred to as "vanes", and they have lower bulk and higher strength than down feathers.

Batting includes tree cotton and synthetic cotton, and the synthetic fibers of synthetic cotton may be polyethylene, polypropylene or rayon.

[Production Method]

The heat retaining article of the invention is not particularly restricted and may be produced using any technology known in the technical field, and an example of a production method for the heat retaining article 1 according to the first embodiment will now be described.

The first sheet 12, third sheet 14 and second sheet 13 are layered in that order to form a layered sheet to be joined. The layered sheet to be joined is then joined by embroidering, to form a layered sheet comprising a plurality of joining sections 11 as stitched sections. Next, the layered sheet is cut to form multiple parts to compose the heat retaining article 1, and the perimeters of each of the parts are sewn together while filling the filler 15 between the third sheet 14 and second sheet 13 of each of the parts, to complete each of the parts. Finally, the multiple parts that are to compose the heat retaining article 1 are sewn together to complete the heat retaining article 1 of the first embodiment.

The heat retaining article of the invention may be used in any product that requires thermal insulation, and considering that it has few cold spots and can be provided with lighter weight, it may be a heat retaining article for animals, such as mammals, including humans, for example.

Examples of heat retaining articles for animals include apparel, such as winter clothing including jackets (for example, down jackets), vests, caps, gloves, shoes, arm and foot warmers, arm and foot covers, ski wear and mountaineering wear.

Examples of heat retaining articles for animals other than apparel include sleeping bags, leg rugs, futons, seat cushions and other cushions.

EXAMPLES

The present invention will now be explained in greater detail by examples.

Production Example 1

Fabrics comprising nylon and polyester were selected for the first sheet and second sheet, a nonwoven fabric was selected as the third sheet, and these were layered in the order of first sheet, third sheet and second sheet to form a layered sheet. Next, the layered sheet was embroidered at the plurality of joining sections to form stitched sections having cross-sections in the planar direction that were circular with diameters of 3 mm (hereunder referred to simply as "circular stitched sections"). The circular stitched sections were arranged at a pitch of 42 mm at the intersections between the group of first imaginary lines and the group of second imaginary lines, as shown in FIG. 4.

The layered sheet was cut into a 200×200 mm square, the perimeter of the cut layered sheet was sewn up, and a mixture of down feathers and feathers (vanes) was filled in as a filler between the second sheet and the third sheet, to a basis weight of 70 g/m$^2$, to produce a simple heat retaining article No. 1. The filler had an FP of 650, and contained down and feathers at 90 mass % and 10 mass %, respectively. The value X obtained by formula (1) was 1667.

Production Example 2

A simple heat retaining article No. 2 was produced in the same manner as Production Example 1, except that the pitch of the stitched section was changed to 63 mm, and the basis weight of the filler was changed to 100 g/m$^2$. The simple heat retaining article No. 2 had a value X of 1587.

Production Example 3

A simple heat retaining article No. 3 was produced in the same manner as Production Example 1, except that the pitch of the stitched section was changed to 85 mm, and the basis weight of the filler was changed to 130 g/m$^2$. The simple heat retaining article No. 3 had a value X of 1529.

Comparative Production Example 1

A simple heat retaining article No. 4 was produced in the same manner as Production Example 1, except that the joining sections were changed from circular stitched sections to embroidering-stitched sections with straight linear cross-sections in the planar direction (hereunder referred to simply as "straight linear stitched sections") (pitch: 30 mm).

Comparative Production Example 2

A simple heat retaining article No. 5 was produced in the same manner as Production Example 2, except that the joining sections were changed from circular stitched sections to straight linear stitched sections (pitch: 45 mm).

Comparative Production Example 3

A simple heat retaining article No. 6 was produced in the same manner as Production Example 3, except that the joining sections were changed from circular stitched sections to straight linear stitched sections (pitch: 60 mm).

The pitch of the straight linear stitched sections used in each of the simple heat retaining article Nos. 4 to 6 was a common one in the technical field, related to the basis weight of the filler.

Reference Production Example 1 to Reference Production Example 3

Simple heat retaining article Nos. 7 to 9 were each produced in the same manner as Production Examples 1 to 3, except that no circular stitched sections were formed.

The properties of the simple heat retaining articles No. 1 to No. 9 are shown in Table 1.

TABLE 1

| Simple heat retaining article No. | Filler basis weight (g/m$^2$) | Joined sections Shape | Joined sections Pitch (mm) | Number density of joined sections (num/m$^2$) | Value X (X = A × √n) |
|---|---|---|---|---|---|
| No. 1 | 70 | Circular | 42 | 567 | 1667 |
| No. 2 | 100 | Circular | 63 | 251 | 1587 |
| No. 3 | 130 | Circular | 85 | 138 | 1529 |
| No. 4 | 70 | Straight linear | 30 | — | — |
| No. 5 | 100 | Straight linear | 45 | — | — |
| No. 6 | 130 | Straight linear | 60 | — | — |
| No. 7 | 70 | — | — | — | — |
| No. 8 | 100 | — | — | — | — |
| No. 9 | 130 | — | — | — | — |

Example 1

[Heat Retaining Property Test]

A heat retaining property test was conducted in the following manner.

(1) A THERMO LABO IIB Precise and Fast Thermal Property-Measuring Instrument (product of Kato Tech Corp.) was prepared in a steady temperature and humidity room at 20° C. and a humidity of 65% RH.

(2) A jig for holding of the sample was set on the heater of the apparatus, and the temperature of the heater was kept at 30° C.

(3) The power consumption of the heater: $W_1$ (W) was measured without setting the sample on the jig.

(4) Each sample (heat retaining articles No. 1 to No. 6) was set on the jig, and the power consumption: $W_2$ (W) at 1 minute after setting was measured. The sample was set so as to cover the heater across a distance of about 1 cm from the heater.

(5) The heat insulation rate (%) was calculated by the following formula (2):

$$\text{Heat insulation rate (\%)}=100\times(W_1-W_2)/W_1 \qquad \text{formula (2).}$$

The results are shown in Table 2.

TABLE 2

| Simple heat retaining article No. | Filler basis weight ($g/m^2$) | Joined sections Shape | Joined sections Pitch (mm) | Heat insulation rate (%) | Probability of 23° C. or higher (%) |
|---|---|---|---|---|---|
| No. 1 | 70 | Circular | 42 | 75.8 | 14.5 |
| No. 2 | 100 | Circular | 63 | 79.0 | 6.9 |
| No. 3 | 130 | Circular | 85 | 81.3 | 3.8 |
| No. 4 | 70 | Straight linear | 30 | 71.8 | 44.9 |
| No. 5 | 100 | Straight linear | 45 | 76.7 | 14.8 |
| No. 6 | 130 | Straight linear | 60 | 79.6 | 8.3 |

Table 2 shows that the simple heat retaining article Nos. 1 to 3 having circular stitched sections each had a higher heat insulation rate compared to the simple heat retaining article Nos. 4 to 6 that had straight linear stitched sections and equivalent basis weight of the filler.

For the heat retaining property test, the sample was photographed by thermography from the opposite side of the heater, 60 seconds after heating. Based on the images taken by thermography, the surrounding regions of the circular stitched sections in the simple heat retaining article Nos. 1 to 3, and the surrounding regions of the straight linear stitched sections in the simple heat retaining article Nos. 4 to 6, were confirmed to be at higher temperature than the sections other than the stitched sections. This means that heat from the circular stitched sections and the straight linear stitched sections was released to the outside, allowing the stitched sections of the heat retaining article to form cold spots during use.

Next, based on the thermography images, a continuous probability distribution graph was drawn with temperature (° C.) on the abscissa and relative frequency (%) on the ordinate. The continuous probability distribution graphs for the simple heat retaining article Nos. 1 to 3 are shown as solid lines in FIG. 7(*a*) to FIG. 7(*c*), and the continuous probability distribution graphs for the simple heat retaining article Nos. 4 to 6 are shown as dotted lines in FIG. 7(*a*) to FIG. 7(*c*).

The probability (%) of 23° C. or higher temperature that can form cold spots during use was calculated, using the continuous probability distribution graphs for the simple heat retaining article Nos. 1 to 6. The results are shown in Table 2.

Figure 7A:
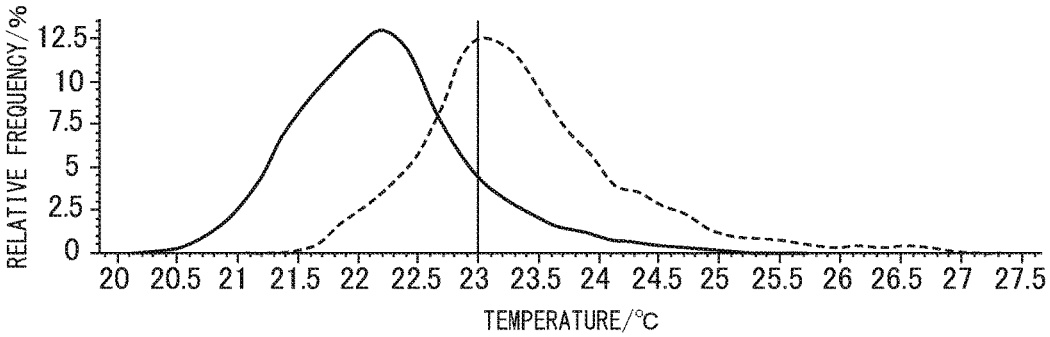
FIGS. 7(*a*)-7(*c*) are a set of continuous probability distribution graphs for simple heat retaining article Nos. 1 to 6.
Figure 7B:
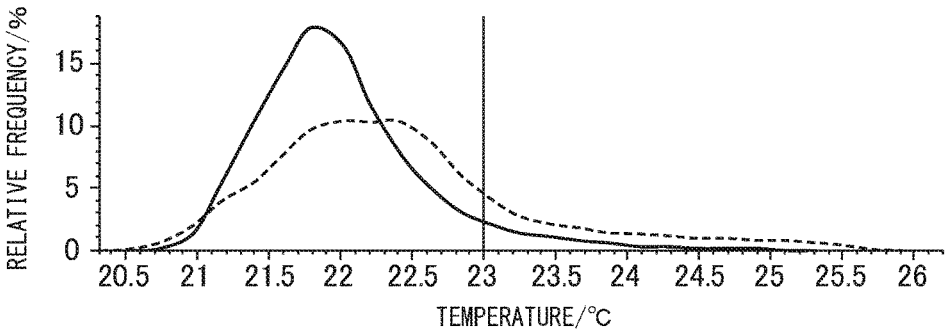
Figure 7C:
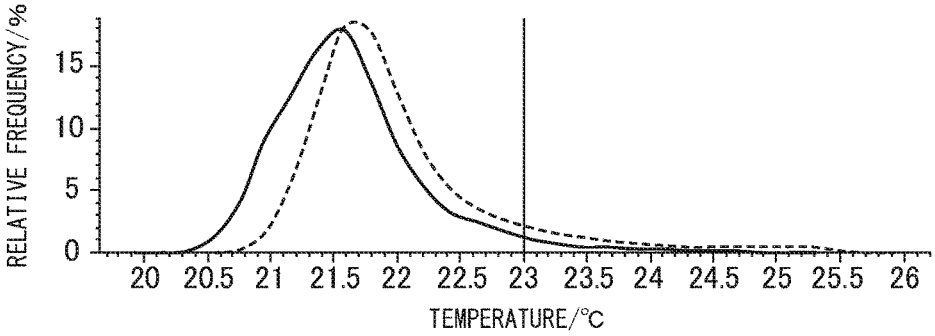

Based on Table 2 and FIG. 7, it is seen that the simple heat retaining article Nos. 1 to 3 have a lower probability of 23° C. or higher temperature in the continuous probability distribution and are less likely to form cold spots, compared to the simple heat retaining article Nos. 4 to 6.

Example 2

[Deviation Test]

A deviation test was conducted in the following manner, in a steady temperature and humidity room at 20° C. and a humidity of 65% RH.

(1) The samples (simple heat retaining article Nos. 1 to 9) were each set on a flat section.

(2) Cardboard (mass: 50 g) with the same size as each sample (200×200 mm) was placed on the sample.

(3) At 30 seconds after placement of the cardboard, the thickness of the sample (the height from the flat section to the bottom face of the cardboard) (mm) was measured.

Figure 8:
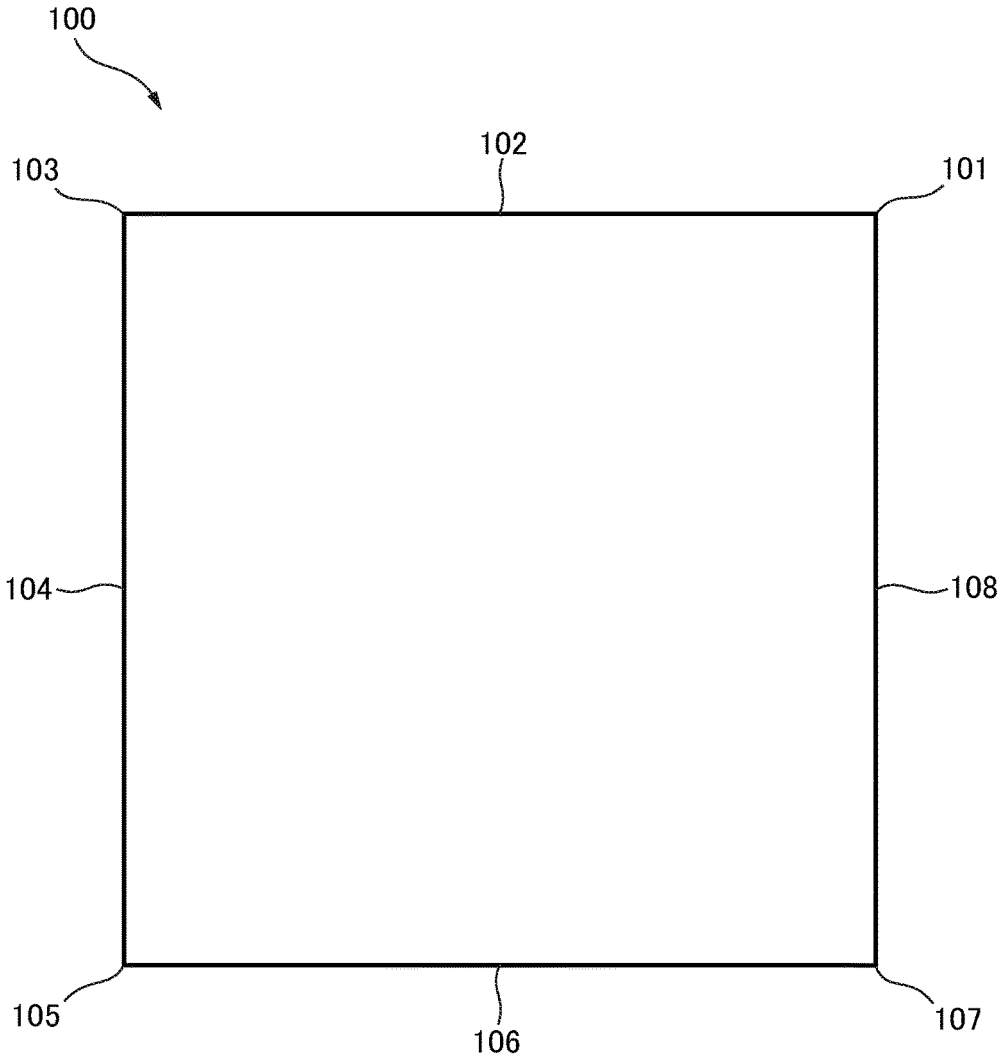
FIG. 8 is a diagram for illustration of the sample thickness measurement region in a deviation test.

(4) The thickness was measured in region 101 to region 108 shown in FIG. 8.

The average of regions 101 to 103 is designated as "top side thickness", the region 104 is designated as "left side thickness", the region 108 is designated as "right side thickness" and the average of regions 105 to 107 is designated as "bottom side thickness". The thickness was measured 5 times for the different samples, and the average value was used. The results are shown in Table 3.

(5) In a DeMattia Flexing Fatigue Tester, the sample was fixed with regions 101 to 103 as the top side, and the sample was vibrated in the vertical direction under conditions with a vertical direction amplitude of 200 mm, a vibrational frequency of 110 times/min and a time of 30 minutes, for deviation testing.

The conditions were designed to simulate walking at a speed of 5 km/hr for 30 minutes. A stopper was also set in the DeMattia Flexing Fatigue Tester for an amplitude of 0 in the horizontal direction. The samples of simple heat retaining article Nos. 4 to 6 were also set in the DeMattia Flexing Fatigue Tester, with the straight linear stitched sections parallel to the horizontal direction.

(6) The deviation tested samples were measured for top side thickness, bottom side thickness, left side thickness and right side thickness. The thickness was subjected to deviation test measurement 5 times for the different samples, and the average value was used. The results are shown in Table 3.

TABLE 3

| Simple heat retaining article No. | Filler basis weight (g/m²) | Joined sections Shape | Joined sections Pitch (mm) | Before deviation test Top side thickness (mm) | Before deviation test Bottom side thickness (mm) | Before deviation test Side thicknesses (mm) left/right | After deviation test Top side thickness (mm) | After deviation test Bottom side thickness (mm) | After deviation test Side thicknesses (mm) left/right | After deviation test Bottom side thickness − top side thickness | After deviation test Left side thickness − right side thickness |
|---|---|---|---|---|---|---|---|---|---|---|---|
| No. 1 | 70 | Circular | 42 | 12.9 | 13.5 | 14.0/13.0 | 12.0 | 13.3 | 13.0/13.0 | 1.3 | 0.0 |
| No. 2 | 100 | Circular | 63 | 16.5 | 18.0 | 18.0/17.0 | 16.8 | 18.3 | 18.0/17.5 | 1.5 | 0.5 |
| No. 3 | 130 | Circular | 85 | 22.0 | 23.0 | 22.0/22.5 | 21.3 | 24.0 | 21.5/22.0 | 2.7 | −0.5 |
| No. 4 | 70 | Straight linear | 30 | 11.8 | 11.3 | 12.0/11.0 | 11.3 | 11.7 | 11.5/11.5 | 0.4 | 0.0 |
| No. 5 | 100 | Straight linear | 45 | 16.2 | 15.0 | 15.5/15.5 | 16.5 | 15.8 | 16.5/14.0 | −0.7 | 2.5 |
| No. 6 | 130 | Straight linear | 60 | 16.5 | 17.5 | 17.5/16.5 | 16.5 | 18.0 | 19.0/16.0 | 1.5 | 3.0 |
| No. 7 | 70 | — | — | 19.5 | 18.2 | 20.0/19.0 | 13.3 | 28.3 | 18.5/22.0 | 15.0 | −3.5 |
| No. 8 | 100 | — | — | 26.5 | 25.5 | 27.0/25.5 | 23.2 | 29.8 | 26.0/26.0 | 6.6 | 0.0 |
| No. 9 | 130 | — | — | 28.3 | 29.3 | 28.5/29.0 | 17.0 | 42.8 | 32.0/28.0 | 25.8 | 4.0 |

From Table 3 it is seen that the simple heat retaining article Nos. 1 to 3 which had circular stitched sections each had a greater thickness both before the deviation test and after the deviation test, compared to the simple heat retaining article Nos. 4 to 6 which had straight linear stitched sections and equivalent basis weight of the filler. Thus, the simple heat retaining article Nos. 1 to 3 therefore had greater bulk of the filler than the simple heat retaining article Nos. 4 to 6, or in other words, presumably the filler held a larger air layer and the heat retaining properties were more excellent.

Also, as demonstrated in the deviation test, the simple heat retaining article Nos. 1 to 3, while having fillers with bulk, had the same low likelihood of maldistribution of the fillers in the vertical direction (bottom side thickness to top side thickness), equivalent to that of the simple heat retaining article Nos. 4 to 6. This suggests that the simple heat retaining article Nos. 1 to 3 are less likely to have maldistribution of the fillers even after prolonged use.

Moreover, as demonstrated by the deviation test, the simple heat retaining article Nos. 1 to 3 exhibited no particular maldistribution of the fillers in the horizontal direction (left side thickness to right side thickness). On the other hand, it was also demonstrated in the deviation test that the simple heat retaining article Nos. 4 to 6 were more likely to have maldistribution of the fillers in the horizontal direction with higher basis weight of the fillers. This therefore suggests that the simple heat retaining article Nos. 4 to 6 are more likely to have maldistribution of the fillers in the horizontal direction after some degree of use.

The present invention relates to the following [1] to [14].

[1]

A heat retaining article comprising a first sheet, a second sheet and a filler situated between the first sheet and the second sheet, wherein the heat retaining article comprises a plurality of joining sections that join the first sheet and the second sheet, the plurality of joining sections being interspersed with mutual spacings therebetween.

[2]

The heat retaining article according to [1], wherein the filler has a basis weight of 40 to 250 g/m².

[3]

The heat retaining article according to [2], wherein the heat retaining article has a number density of the joining sections that is 50 to 700 per square meter ($m^{-2}$) in a planar direction.

[4]

The heat retaining article according to [3], wherein a value X, obtained by the following formula (1):

$$X = A \times \sqrt{n} \qquad \text{formula (1)}$$

wherein A is the basis weight of the filler (g/m²), and n is the number density of the joining sections ($m^{-2}$), is in a range of 1,400 to 1,800.

[5]

The heat retaining article according to any one of [1] to [4], wherein in a planar direction of the heat retaining article, the plurality of joining sections are arranged on a plurality of first imaginary lines that extend in a first direction and are mutually parallel.

[6]

The heat retaining article according to [5], wherein in the planar direction of the heat retaining article, the plurality of joining sections are arranged on a plurality of second imaginary lines that extend in a second direction and are mutually parallel.

[7]

The heat retaining article according to [6], wherein the plurality of the first imaginary lines and the plurality of the second imaginary lines have intersections, and the plurality of joining sections are arranged on the intersections.

[8]

The heat retaining article according to [7], wherein on the first imaginary lines and/or the second imaginary lines, the plurality of joining sections are arranged at a pitch in a range of 20 to 150 mm.

[9]

The heat retaining article according to any one of [1] to [8], wherein the filler includes down feathers and feathers.

[10]

The heat retaining article according to any one of [1] to [9], wherein each of the plurality of joining sections is selected from the group consisting of stitched sections, bonded sections, fused sections, caulked sections, and any combinations thereof.

[11]

The heat retaining article according to any one of [1] to [10], wherein cross-sections of the stitched sections in a planar direction of the heat retaining article have circular or elliptical shapes.

[12]

The heat retaining article according to any one of [1] to [11], wherein the heat retaining article further comprises a third sheet made of a fabric, between the filler and the second sheet.

[13]

The heat retaining article according to any one of [1] to [12], wherein the heat retaining article further comprising, on an outer side of the second sheet, a cover sheet that covers the second sheet without being joined by the plurality of joining sections.

[14]

The heat retaining article according to any one of [1] to [13], wherein the heat retaining article is an article of apparel.

REFERENCE SIGNS LIST

1 Heat retaining article
2 Front body region
3 Rear body region
4 Flank abdominal region
5 Sleeve lower section
6 Sleeve section
7 Collar section
8 Fastener section
11 Joining section
12 First sheet
13 Second sheet
14 Third sheet
15 Filler
16 Cover sheet
21 Outer side

The invention claimed is:

1. A heat retaining article comprising a first sheet, a second sheet, and a filler situated between the first sheet and the second sheet, wherein the heat retaining article comprises a plurality of joining sections that join the first sheet and the second sheet without the filler in the joining sections, the plurality of joining sections being interspersed with mutual spacings therebetween, wherein the filler comprises down feathers and feathers, wherein the filler has a basis weight of 40 to 250 g/m$^2$, wherein the heat retaining article has a number density of the plurality of joining sections that is 50 to 700 per square meter (m$^{-2}$) in a planar direction, and wherein a value X, obtained by the following formula (1), ranges from 1,400 to 1,800:

$$X=A\times\sqrt{n} \quad (1)$$

where A is the basis weight of the filler (g/m$^2$), and n is the number density of the plurality of joining sections (m$^{-2}$).

2. The heat retaining article according to claim 1, wherein in a planar direction of the heat retaining article, the plurality of joining sections are arranged on a plurality of first imaginary lines that extend in a first direction and are mutually parallel.

3. The heat retaining article according to claim 2, wherein in the planar direction of the heat retaining article, the plurality of joining sections are arranged on a plurality of second imaginary lines that extend in a second direction and are mutually parallel.

4. The heat retaining article according to claim 3, wherein the plurality of the first imaginary lines and the plurality of the second imaginary lines have intersections, and the plurality of joining sections are arranged on the intersections.

5. The heat retaining article according to claim 4, wherein on the first imaginary lines and/or the second imaginary lines, the plurality of joining sections are arranged at a pitch in a range of 20 to 150 mm.

6. The heat retaining article according to claim 1, wherein each of the plurality of joining sections is selected from the group consisting of stitched sections, bonded sections, fused sections, caulked sections, and any combinations thereof.

7. The heat retaining article according to claim 1, wherein each of the plurality of joining sections is a stitched section, and a cross-section of each of the stitched sections in a planar direction of the heat retaining article has a circular or elliptical shape.

8. The heat retaining article according to claim 1, wherein the heat retaining article further comprises a third sheet made of a fabric, between the filler and the second sheet.

9. The heat retaining article according to claim 1 wherein the heat retaining article further comprising, on an outer side of the second sheet, a cover sheet that covers the second sheet without being joined by the plurality of joining sections.

10. An article of apparel comprising the heat retaining article according to claim 1.

11. The heat retaining article according to claim 1, wherein each of the plurality of joining sections is a stitched section that is formed by embroidering.

12. The heat retaining article according to claim 11, wherein a cross-section of each of the stitched sections in a planar direction of the heat retaining article has a circular or elliptical shape.

* * * * *